United States Patent [19]

Teichmann

[11] 4,240,181

[45] Dec. 23, 1980

[54] WEB GUIDING DEVICE

[75] Inventor: Paul G. Teichmann, Monchen-Gladbach, Fed. Rep. of Germany

[73] Assignee: Trützschler GmbH & Co. KG, Monchen-Gladbach, Fed. Rep. of Germany

[21] Appl. No.: 918,441

[22] Filed: Jun. 23, 1978

[30] Foreign Application Priority Data

Jul. 15, 1977 [DE] Fed. Rep. of Germany ..... 2732017

[51] Int. Cl.[3] ..... D01G 31/00; B65H 25/02

[52] U.S. Cl. ..... 19/0.25; 19/65 R; 19/150; 226/11; 226/24; 242/54.4; 242/55.1

[58] Field of Search ..... 226/24, 11, 45, 10, 226/196, 198, 199; 242/54.4, 55.1; 19/0.2, 0.22, 0.25, 65 CR, 150; 200/61.13, 61.18

[56] References Cited

U.S. PATENT DOCUMENTS 3,443,283 5/1969 Whitehurst ..... 19/0.25

FOREIGN PATENT DOCUMENTS 816442 7/1959 United Kingdom ..... 19/0.25

*Primary Examiner*—Stanley N. Gilreath

*Attorney, Agent, or Firm*—Spencer & Kaye

[57] ABSTRACT

A device for withdrawing and gathering a fiber web discharged by a web delivering assembly of a carding machine includes a guide element arranged immediately downstream of the web delivering assembly and has a web guiding face; a support for positioning the guiding face to be movable towards and away from the web delivering assembly; an arrangement for urging the guiding face towards the web delivering assembly into a closed position with a predetermined force; a switch supported adjacent the guiding face for actuation by the guiding face upon movement of the guiding face away from the web delivering assembly in response to a web pressure opposing and exceeding the predetermined force; and an arrangement connected to the switch and responsive to the actuation thereof.

11 Claims, 4 Drawing Figures

WEB GUIDING DEVICE

BACKGROUND OF THE INVENTION

This invention relates to a device for withdrawing and gathering a fiber web discharged by the web delivering assembly of a carding machine. The invention relates particularly to a web guiding device which comprises a guide element mounted immediately downstream of the web delivering assembly and which has a usually plate-like guiding face extending transversely to the direction of web feed. The guiding face has a hollow side oriented towards the web delivering assembly for gathering the web-upon its discharge by the web delivering assembly-into a running sliver advanced from the guide element for further processing and/or handling. Such an arrangement is described in U.S. patent application by Beneke et al, Ser. No. 887,215, filed Mar. 16, 1978.

As the web is discharged by the web delivering assembly arranged downstream of the carding cylinder, parts of the web may rupture. The broken web portions are fully drawn off by the calender rolls. The successive web portion, however, cannot be drawn by the calender rolls because, at this time, there is no connection between the leading end of the successive web portion and the bite of the calender rolls. Thus, the web accumulates in the space between the guiding face of the guide element and the web delivering assembly of the carding machine.

SUMMARY OF THE INVENTION

It is an object of the invention to provide a web guiding device which senses an undesired web accumulation in the space between the guiding face of the guide element and the web delivering assembly of the carding machine and which, upon sensing such an occurrence, may effect stoppage of the web delivery and make possible an elimination of the accumulated web material.

This object and others to become apparent as the specification progresses, are accomplished by the invention, according to which, briefly stated, the device for withdrawing and gathering a fiber web discharged by a web delivering assembly of a carding machine includes a guide element arranged immediately downstream of the web delivering assembly and has a web guiding face; a support for positioning the guiding face to be movable towards and away from the web delivering assembly; an arrangement for urging the guiding face towards the web delivering assembly into a closed position with a predetermined force; a switch supported adjacent the guiding face for actuation by the guiding face upon movement of the guiding face away from the web delivering assembly in response to a web pressure opposing and exceeding the predetermined force; and an arrangement connected to the switch and responsive to the actuation thereof.

The guiding face of the guide element is, according to the invention, adjustable, for example, by shifting or swinging displacement. In case a web accumulation occurs in the space between the web delivering assembly and the guiding face, the pressure exerted by the web outwardly on the guiding face increases. This increased pressure causes the guiding face to move (for example, to pivot) outwardly and, in the course of this motion, the guiding face actuates a limit switch which, in turn, may operate a visual or acoustic display to indicate an operational disturbance, whereupon the guiding element may be manually opened for eliminating the cause of trouble. Advantageously, the limit switch may operate an opening device which automatically moves the web guiding element into an open position, away from the rolls of the web delivering assembly. Expediently, the limit switch may operate a shutoff device for simultaneously stopping the delivery of web from the carding machine. According to a particularly advantageous embodiment of the invention, the limit switch is actuated upon a deviation of the guiding element from its predetermined end position with respect to the web delivering assembly, whereby a guide element opening device is actuated and simultaneously the web delivery is stopped. In this embodiment, the limit switch is first actuated by virtue of the pressure derived from the web accumulation to cause stoppage of further web delivery and simultaneously an opening of the guide element is effected for providing access to eliminate the disturbance.

For allowing a rotation or swinging motion of the web guiding element, the latter is expediently supported by a hinge assembly. Such an arrangement has the advantage that apart from the change of position caused by the increased pressure due to the web accumulation, an opening of the web guiding element can also be effected for the purpose of subsequently removing the cause of the disturbance. In this embodiment, the support of, for example, the hinge member can be combined with an adjustable spring for regulating the web pressure. Thus, only when the predetermined web pressure is exceeded will the limit switch be actuated by the outwardly pivoting web guiding element. The limit switch may expediently be constituted by a microswitch in view of the very small displacements of parts.

In accordance with an advantageous feature of the invention, the web guiding element is spring-loaded, for example, by means of a leaf spring which is mounted with the web guiding element on a support arm. In the alternative, the limit switch may be secured with a spring bias directly to the web guiding element. This arrangement provides that subsequent to the removal of the cause of the disturbance, the web guiding element is automatically returned to its working position by moving it in the direction of the web delivering assembly.

DESCRIPTION OF THE PREFERRED EMBODIMENTS

Figure 1:
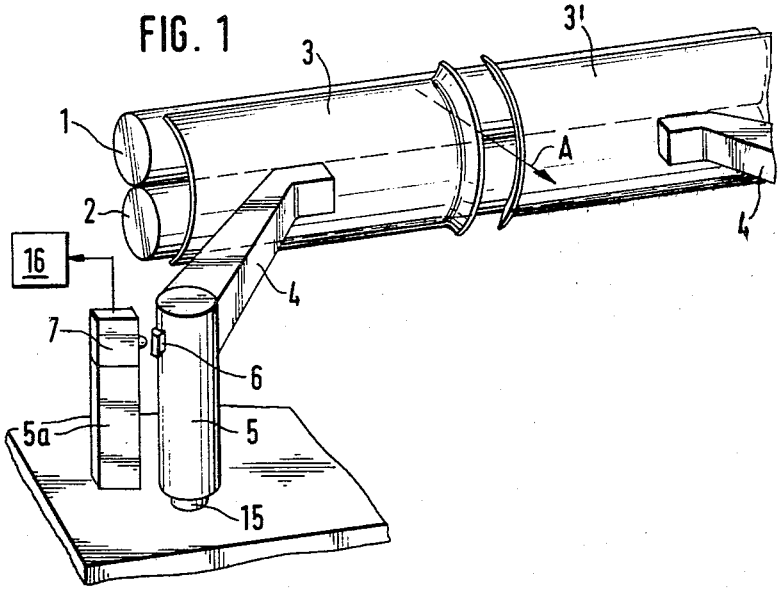
FIG. 1 is a schematic perspective view of a preferred embodiment of the invention.

Turning now to FIG. 1, there are shown crush rolls 1 and 2 forming part of a web delivering assembly situated downstream of the main cylinder of a carding machine, as viewed in the direction of web feed indicated by the arrow A. Immediately downstream of the crush rolls 1 and 2, there is arranged a web guiding element formed of two guiding faces 3, 3 each affixed laterally by means of a support arm 4 to a support sleeve 5 which is rotatable on a pin 15 about a vertical axis. The support sleeve 5 carries a lug 6 which cooperates with a limit switch 7 (such as a microswitch) stationarily supported on a post 5*a*. Expediently, the arm 4 is urged in the direction of the crush rolls 1, 2 with a predetermined spring force which may be supplied, for example, by a spiral spring surrounding the pin 15 and attached, at one spring end, to the pin 15 and, at the other spring end, to the support sleeve 5. If, during operation, a web accumulation occurs between the guiding faces 3, 3' and the crush rolls 1, 2, the normal, outwardly directed pressure on the guiding faces increases, causing the arm 4 to pivot away from the crush rolls 1, 2 thus actuating the limit switch 7, which, in turn, causes energization of an indicating device 16. Subsequently, the guiding faces 3, 3' may be manually rotated away from the crush rolls 1 and 2 to such an extent that free access may be gained to the web accumulation and thus the disturbance caused thereby can be eliminated.

Figure 2:
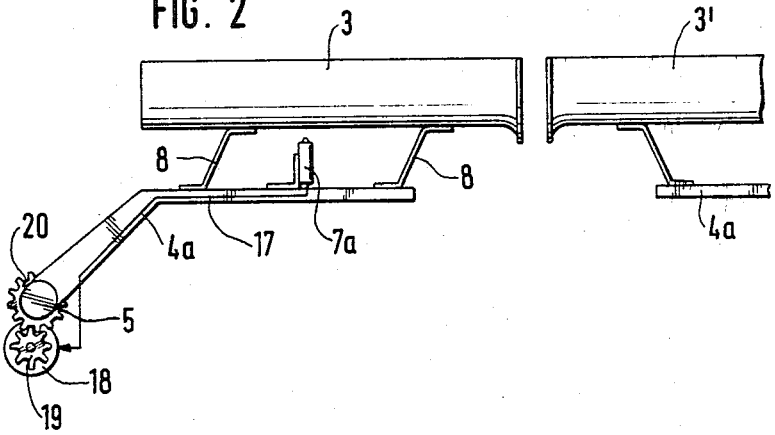
FIG. 2 is a schematic top plan view of another preferred embodiment of the invention.

Turning now to the embodiment illustrated in FIG. 2, each guiding face 3, 3' is connected with the respective support arm 4*a* by means of leaf springs 8 which hold the guiding faces 3, 3' in a spaced relationship from their respective support arm 4*a*. Each support arm 4*a* is mounted on a respective pivotal support sleeve 5. To that side of the arm 4*a* which is oriented towards the respective guiding face, there is mounted a limit switch 7*a*. The latter is thus arranged between the leaf springs 8 and in the space defined between the arm 4*a* and the associated guiding face 3 or 3'.

If, during operation, the pressure of the web exerted on the guiding faces exceeds (due to a web accumulation) a predetermined magnitude, the leaf springs 8 yield to such an extend that a part of the back side of the respective guiding face contacts the limit switch 7*a* and actuates the same. The limit switch 7*a*, in turn, energizes a motor 18 with which it is connected by means of a conductor 17. The output shaft of the motor 18 carries a spur gear 19 which meshes with a spur gear 20 affixed to the support sleeve 5. Thus, as the motor 18 turns the support sleeve 5, the support arm 4*a*, together with the leaf springs 8 and the guiding face 3 or 3', respectively, is swung automatically away from the crush rolls 1 and 2 (not shown in FIG. 2) to provide the required accessibility for removing the disturbance caused by web accumulation.

Figure 3:
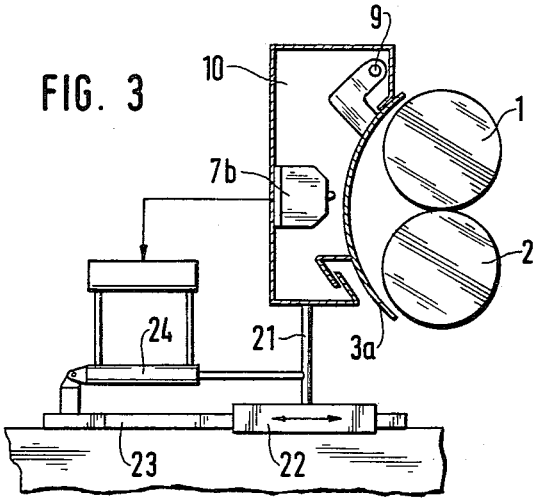
FIGS. 3 and 4 are schematic side elevational sections of two further preferred embodiments of the invention.

In the embodiment illustrated in FIG. 3, to the guiding face 3*a* of the web guiding element there is secured a pivotal support 9 rotatable about a horizontal axis. To a carrier 10 to which the pivotal support 9 is attached, there is further mounted a limit switch 7*b* which is oriented towards the back side of the guiding face 3*a*. The limit switch 7*b* is actuated by the back side of the guiding face 3*a* upon clockwise pivotal motion of the latter in response to the pressure exerted thereon by the accumulated web. In this embodiment the web pressure seeking to move the guiding face 3*a* away from the crush rolls 1 and 2 is opposed by the force derived from the weight of the component 3*a*. The carrier 10 is, by means of a post 21, mounted on a carriage 22 which is displaceable on a track 23 towards and away from the crush rolls 1 and 2. A drive 24, such as a pneumatic power cylinder unit, controlled by the limit switch 7*b*, is coupled to the post 21. Thus, upon actuation of the limit switch 7*b*, the drive 24 is energized and shifts the carriage 22, together with the guiding face 3*a* mounted thereon, linearly away from the crush rolls 1 and 2.

Figure 4:
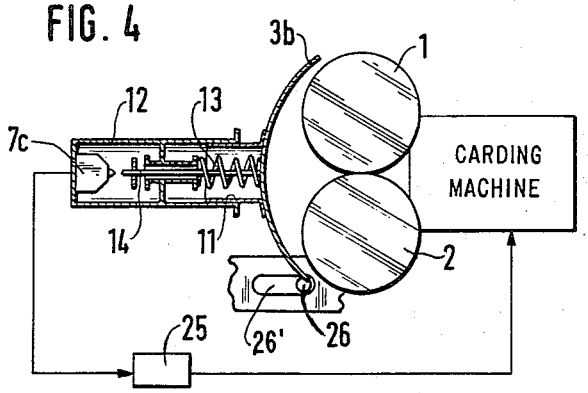

In the embodiment illustrated in FIG. 4, to the guiding face 3*b*, at its side oriented away from the crush rolls 1, 2, there is affixed a sliding guide 11 which is horizontally displaceable in a stationary track 12. Within the sliding guide 11, there is arranged a rod 14 which is biased by a compression spring 13 and which cooperates with a limit switch 7*c* also secured to the stationary track 12. The entire assembly formed of components 3*b*, 7*c* and 11–14 is, as a unit, pivotal about an articulation 26. In response to a pressure derived from a web accumulation in the space between the pressure rolls 1 and 2, on the one hand, and the guiding face 3*b*, on the other hand, the guiding face 3*b* is, against the force of the spring 13, forced linearly away from the crush rolls 1, 2. For this purpose, the articulation 26 is mounted in a horizontally extending slot 26' to permit such a linear shift. The slot 26' may be provided, for example, in a component that forms part of the machine frame. The rod 14 shifts with the guiding face 3*b* as a unit and actuates the limit switch 7*c*. The latter is coupled to a shutoff device (such as a circuit breaker) 25 which, when actuated by the limit switch 7*c* interrupts the operation, for example, of the tuft feed roll of the carding machine and, as a result, the feed of fiber tufts to the carding machine is interrupted and, consequently, there will be no web output at the crush rolls of the web delivering assembly. Thereafter, the guiding face 3*b*, together with the components 7*c* and 11–14 mounted thereon can be pivoted downwardly about the articulation 26 away from the crush rolls 1 and 2, thus providing access to remove the operational disturbance caused by the web accumulation. The assembly (comprising the components 3*b*, 7*c* and 11–14) pivotal about the articulation 26 is maintained in its upwardly-pivoted position as shown in FIG. 4, for example, by means of a conventional, manually releasable lock mounted on the machine frame.

It is to be understood that the above description of the present invention is susceptible to various modifications, changes and adaptations, and the same are intended to be comprehended within the meaning and range of equivalents of the appended claims.

What is claimed is:

1. In a carding machine including a device for withdrawing and gathering a fiber web discharged by a web delivering assembly of the carding machine; the device including a guide element arranged immediately downstream of the web delivering assembly and having a web guiding face for gathering into a running sliver the web discharged by said web delivering assembly, said guiding face extending, in a normal operative position, transversely to the direction of web feed of the web delivering assembly; the improvement wherein said device comprises (a) support means for positioning said guiding face to be movable towards and away from said web delivering assembly;

(b) switch means operatively connected with said guiding face for actuating said switch means upon movement of said guiding face away from said web delivering assembly in response to a web pressure exceeding a predetermined force; and (c) means connected to said switch means and responsive to the actuation of said switch means.

2. A carding machine as defined in claim 1, wherein said means connected to said switch means is a signalling device.

3. A carding machine as defined in claim 1, wherein said means connected to said switch means is a shutoff device connected with the carding machine for interrupting web delivery when said switch means is actuated.

4. A carding machine as defined in claim 1, wherein said support means includes pivotal means for swingably supporting said guiding face.

5. A carding machine as defined in claim 4, wherein said support means includes a support arm and spring means for mounting said guiding face on said support arm; said spring means yieldably resisting movement of said guiding face towards said support arm; said switch means being mounted on said support arm for being engaged by said guiding face in the course of the motion thereof.

6. A carding machine as defined in claim 1, further comprising spring means for urging said guiding face towards said web delivering assembly.

7. A carding machine as defined in claim 1, wherein said switch means comprises a microswitch.

8. A carding machine as defined in claim 1, wherein said guiding face cooperates directly with said switch means.

9. A carding machine as defined in claim 1, wherein said support means comprises a carriage supporting said guiding face and said switch means and mounted to be displaceable towards and away from said web delivering assembly; carrier means mounted on said carriage; pivot means for swingably mounting said guiding face on said carrier means; said switch means being attached to said carrier means for actuation by a reverse side of said guiding face upon pivotal motion of said guiding face away from said web delivering assembly; said means connected to said switch means comprising a drive means coupled to said carriage for shifting said carriage and said guiding face as a unit away from said web delivering assembly into an open position when said switch means is actuated.

10. In a device for withdrawing and gathering a fiber web discharged by a web delivering assembly of a carding machine; the device including a guide element arranged immediately downstream of the web delivering assembly and having a web guiding face; the improvement comprising (a) support means for positioning said guiding face to be movable towards and away from said web delivering assembly;

(b) switch means operatively connected with said guiding face for actuating said switch means upon movement of said guiding face away from said web delivering assembly in response to a web pressure exceeding a predetermined force; and (c) opening means connected to said switch means and responsive to the actuation of said switch means for moving said web guiding face away from said web delivering assembly into an open position when said switch means is actuated.

11. In a device for withdrawing and gathering a fiber web discharged by a web delivering assembly of a carding machine; the device including a guide element arranged immediately downstream of the web delivering assembly and having a web guiding face; the improvement comprising (a) support means for positioning said guiding face to be movable towards and away from said web delivering assembly; said support means including (1) a pivotally mounted support arm; and (2) spring means for mounting said web guiding face on said support arm; said spring means yieldably resisting movement of said guiding face towards said support arm;

(b) switch means operatively connected with said web guiding face for actuating said switch means upon movement of said web guiding face away from said web delivering assembly in response to a web pressure exceeding a predetermined force; said switch means being mounted on said support arm for actuation by a reverse side of said web guiding face upon movement of said web guiding face towards said actuating arm; and (c) means connected to said switch means and responsive to the actuation of said switch means; said means connected to said switch means comprising a drive means coupled to said support arm to swing said support arm and said web guiding face as a unit away from said web delivering assembly into an open position when said switch means is actuated.

* * * * *